US010844564B1

(12) United States Patent
Burkett

(10) Patent No.: US 10,844,564 B1
(45) Date of Patent: Nov. 24, 2020

(54) FLOOD CONTROL SYSTEM

(71) Applicant: Glenn Burkett, Coborg (CA)

(72) Inventor: Glenn Burkett, Coborg (CA)

( * ) Notice: Subject to any disclaimer, the term of this patent is extended or adjusted under 35 U.S.C. 154(b) by 0 days.

(21) Appl. No.: 16/680,564

(22) Filed: Nov. 12, 2019

Related U.S. Application Data

(63) Continuation-in-part of application No. 15/821,232, filed on Nov. 22, 2017, now abandoned.

(51) Int. Cl.
*E02B 3/10* (2006.01)
*E02D 29/02* (2006.01)
*E02B 7/00* (2006.01)

(52) U.S. Cl.
CPC ..... *E02B 3/108* (2013.01); *E02B 7/005* (2013.01); *E02D 29/0208* (2013.01)

(58) Field of Classification Search
CPC ..... E02D 29/0208; E02B 3/106; E02B 3/108; E02B 7/005
See application file for complete search history.

(56) References Cited

U.S. PATENT DOCUMENTS 4,394,924 A * 7/1983 Zaccheroni ..... B21F 27/14 220/486
4,594,206 A * 6/1986 Grafton ..... E02B 3/06 264/257
4,921,373 A * 5/1990 Coffey ..... E02B 3/108 256/13
5,333,970 A * 8/1994 Heselden ..... E04C 1/395 405/286
6,012,872 A * 1/2000 Perry ..... E02B 3/108 220/1.6
6,200,067 B1 * 3/2001 Pena ..... E02B 3/108 405/115
7,249,912 B2 * 7/2007 Reese ..... B63B 3/08 404/31
9,057,168 B1 * 6/2015 Dugan, Jr. ..... E02B 7/20
9,481,970 B2 * 11/2016 Scott ..... E02D 29/0208
(Continued)

FOREIGN PATENT DOCUMENTS

EP 1508643 A1 * 2/2005 ..... E02B 3/108
GB 2508148 * 5/2014 ..... F24S 25/617
WO WO-2017220987 A1 * 12/2017 ..... F24S 25/617

*Primary Examiner* — Frederick L Lagman
(74) *Attorney, Agent, or Firm* — Gulf Coast Intellectual Property Group

(57) ABSTRACT

A flood control system that is configured to be deployed so as to control floodwaters wherein the flood control system is provided in multi-cell configurations of modular receptacles. The flood control system includes a plurality of modular receptacles having four walls wherein the four walls are movably coupled so as to transition intermediate a folded position and a deployed position. The walls of the flood control system include a plurality of apertures and corner structures that are helical coil in shape. A locking pin is provided to be operably coupled intermediate modular receptacles so as to provide a mechanical connection therebetween. A liner is disposed within the interior volume of the modular receptacles and is mateable shaped therewith. A lid member is further included and is operable to cover the plurality of modular receptacles. The lid member further includes locking aperture rows so as to inhibit access.

10 Claims, 5 Drawing Sheets

(56) References Cited

U.S. PATENT DOCUMENTS

| | | | | |
|---|---|---|---|---|
| 2002/0110424 | A1* | 8/2002 | Page | E02B 3/108 405/115 |
| 2003/0035689 | A1* | 2/2003 | Metz | E02B 3/108 405/19 |
| 2005/0169712 | A1* | 8/2005 | Young | E02B 3/108 405/116 |
| 2007/0154264 | A1* | 7/2007 | Baruh | E02B 3/108 405/110 |
| 2008/0264546 | A1* | 10/2008 | Olsta | E02D 29/0208 156/91 |
| 2009/0169301 | A1* | 7/2009 | Kim | E02B 3/04 405/15 |
| 2009/0202308 | A1* | 8/2009 | Heselden | E02D 29/0208 405/273 |
| 2009/0230373 | A1* | 9/2009 | Helseden | E06B 9/02 256/25 |
| 2010/0111611 | A1* | 5/2010 | Olsta | E02D 29/0208 405/128.1 |
| 2010/0143049 | A1* | 6/2010 | Heselden | E02D 29/0208 405/284 |
| 2010/0172701 | A1* | 7/2010 | Tucker | E02B 3/108 405/284 |
| 2010/0186642 | A1* | 7/2010 | Christman | E01F 8/025 109/79 |
| 2011/0305511 | A1* | 12/2011 | Heselden | E02B 3/06 405/16 |
| 2012/0134756 | A1* | 5/2012 | Heselden | E02D 29/0208 405/273 |
| 2013/0022404 | A1* | 1/2013 | Stinson | E02D 17/18 405/117 |

* cited by examiner

FLOOD CONTROL SYSTEM

CROSS REFERENCE TO RELATED APPLICATIONS

This application is a continuation-in-part of U.S. patent application Ser. No. 15/821,232 filed, Nov. 22, 2017, entitled, Flood Control System, now abandoned, which is hereby incorporated for reference.

FIELD OF THE INVENTION

The present invention relates generally to flood control, more specifically but not by way of limitation a flood control system configured to assist municipalities and the like to quickly deploy flood control in desired areas wherein the flood control system includes modular receptacles configured for rapid deployment.

BACKGROUND

As the population density increase in various area, the flood plains in these are now being built on in greater density. In years past, municipalities had identified flood plains and the availability of land was such that development in the flood plain areas was minimal. As commercial and residential development has expanded over the last several decades, the once undeveloped floodplains now have commercial and residential development thereon. Further desirable properties such as those near rivers and lakes are prone to rapid flooding in the event of either a natural disaster or a catastrophic failure of structures such as but not limited to a dam.

One issue with existing flood control is the capacity limitation of structures such as but not limited to canals and the inability to rapidly deploy a temporary structure that is operable to inhibit water egress into a certain area. In the event of natural disasters such as but not limited to hurricanes, those municipalities that have canal systems configured to control excess water and the direction thereof often struggle with water control ensuing the capacity of the canals being reached. Examples such as the failure of the dams and canal systems in New Orleans during hurricane Katrina are an example of such deficiencies. Additionally, temporary structures utilized for controlling floodwaters can not quickly be deployed and require significant manpower to install. Conventional technology such as sand bags have proven to provide some relief but sandbags require significant manpower to fill and deploy. Further, sandbags are small and as such they are unable to protect larger areas and typically are utilized to circumferentially surround a structure such as but not limited to a house.

Accordingly, there is a need for a floodwater control system that is configured so as to be rapidly deployed and can be installed so as to cover a significant amount of linear distance in order to provide improved containment of floodwaters.

SUMMARY OF THE INVENTION

It is the object of the present invention to provide a floodwater control system that is configured so as to be rapidly deployed wherein the floodwater control system includes a plurality of modular receptacles.

Another object of the present invention is to provide a floodwater control system operable to inhibit floodwaters from entering a desired area wherein the modular receptacles are constructed of four walls wherein the four walls are manufactured from a metal mesh material.

A further object of the present invention is to provide a floodwater control system that is configured so as to be rapidly deployed wherein the walls of the modular receptacles are constructed so as to provide a first position and a second position of the modular receptacles wherein in the first position the modular receptacles are folded for easy transportation thereof.

Yet a further object of the present invention is to provide a floodwater control system operable to inhibit floodwaters from entering a desired area wherein in the second position the modular receptacle is in an erect position.

Still another object of the present invention is to provide a floodwater control system that is configured so as to be rapidly deployed wherein each modular receptacle has an interior volume and is configured to receive a liner therein.

An additional object of the present invention is to provide a floodwater control system operable to inhibit floodwaters from entering a desired area wherein the modular receptacles include helical coil construction on the corners thereof so as to facilitate the folding thereof.

Yet a further object of the present invention is to provide a floodwater control system that is configured so as to be rapidly deployed wherein the liner includes alternative embodiments such as but not limited to a closed embodiment and an open embodiment.

Another object of the present invention is to provide a floodwater control system operable to inhibit floodwaters from entering a desired area wherein the modular receptacles are placed adjacent to each other and wherein locking pins are utilized to secure adjacent modular receptacles.

An alternate object of the present invention is to provide a floodwater control system that is configured so as to be rapidly deployed wherein the modular receptacles are provided in grouped sets wherein each set includes a quantity of modular receptacles such as but not limited to two or five.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
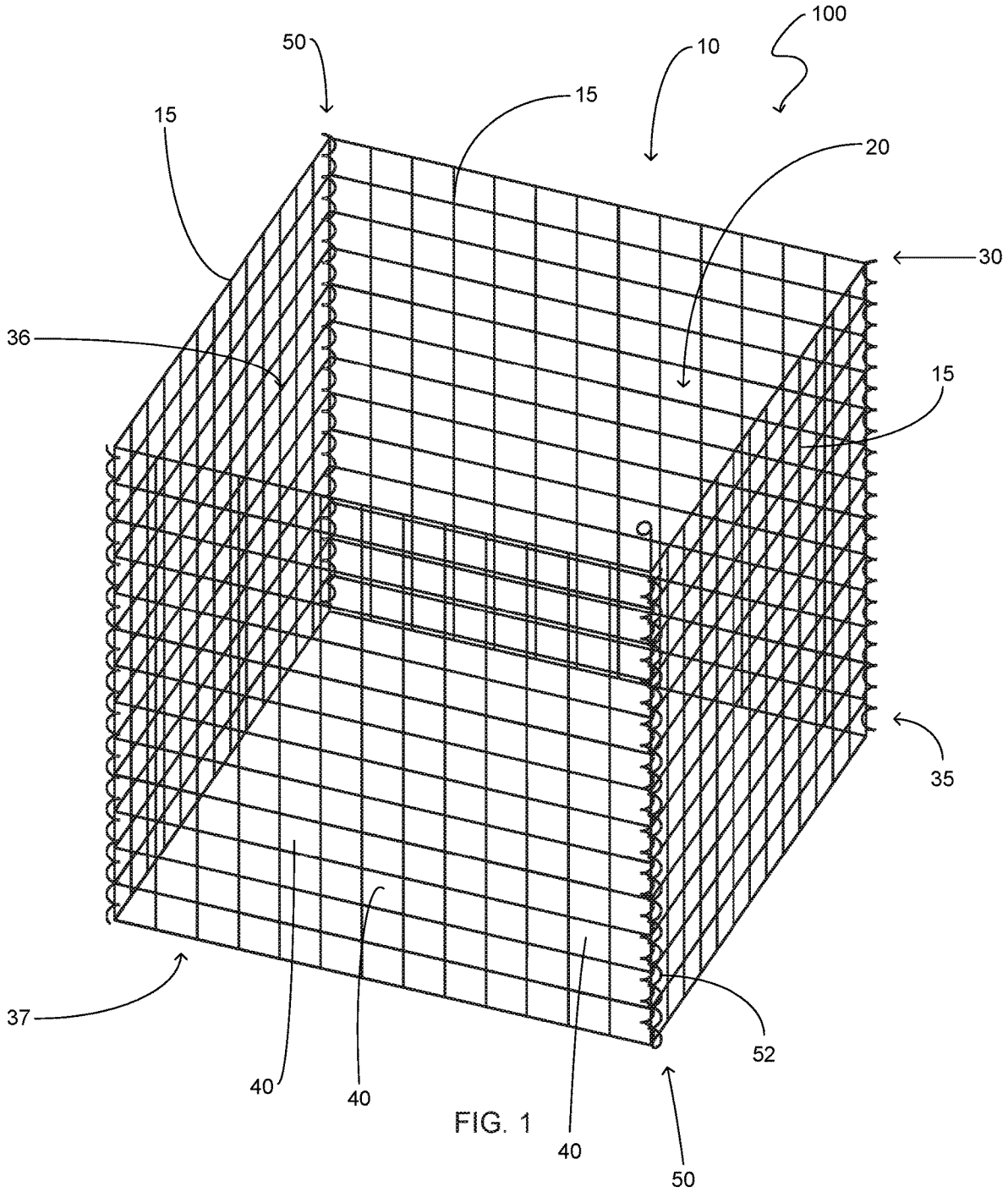
FIG. 1 is a perspective view of one modular receptacle of the present invention.

Referring now to the drawings submitted herewith, wherein various elements depicted therein are not necessarily drawn to scale and wherein through the views and figures like elements are referenced with identical reference numerals, there is illustrated an flood control system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the flood control system 100 includes at least one modular receptacle 10 that is constructed utilizing a plurality of wall panels 15 wherein the wall panels 15 are formed to create an interior volume 20. The modular receptacle 10 includes an upper end 30 and lower end 35 wherein the modular receptacle 10 is constructed so as to have a first opening 36 proximate the upper end 30 and a second opening 37 proximate the lower end 35. The wall panels 15 are manufactured from a durable rigid material having a plurality of apertures 40. While it is contemplated within the scope of the present invention that the wall panels 15 could be constructed of various materials, in a preferred embodiment of the flood control system 100 the walls are constructed from materials such as but not limited to galfan mesh panels. The design and construction of the wall panels 15 provide a lighter weight for the modular receptacle and the apertures 40 further allow the liner 60 to slightly propagate therethrough, which is further discussed herein.

Figure 2:
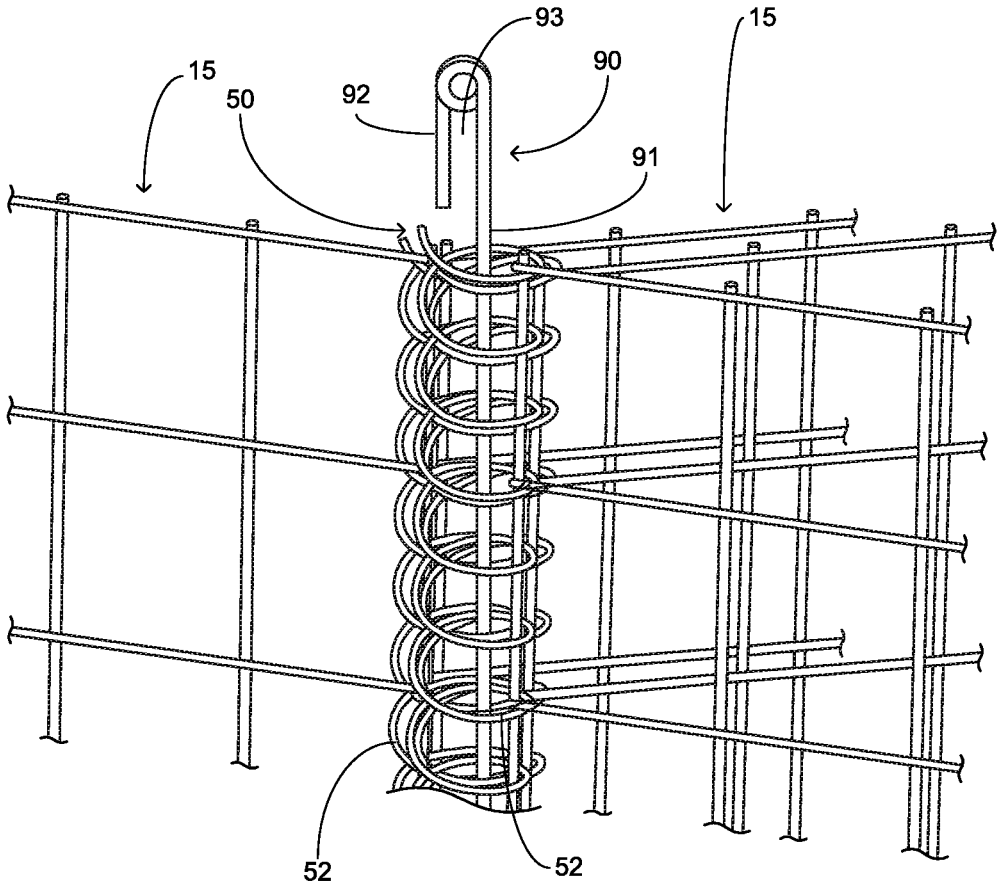
FIG. 2 is a detailed view of the corner construction of the modular receptacles of the present invention.

Now referring to FIG. 2 herein, a detailed view of the corners 50 of the modular receptacle 10 is illustrated therein. Each corner 50 of every wall panel 15 has an integrally formed helical coil structure 52. The helical coil structure 52 is configured to provide an interlocking technique to operably couple each wall panel 15 and further provide the ability to transition a modular receptacle 10 intermediate a folded position and a deployed position. FIG. 1 illustrates a deployed position wherein the wall panels 15 are configured to create a square-shaped modular receptacle 10 that is perpendicular to the ground or other support surface on which the modular receptacle has been superposed. In its folded position(not illustrated herein) the modular receptacle 10 is positioned such that the wall panels 15 are adjacent each other so as to facilitate stacking and transport of the modular receptacles 10. While an interlocking helical coil structure 52 is preferred to facilitate the desired functionality described herein, it is contemplated within the scope of the present invention that the corners 50 could be constructed utilizing alternate techniques in order to provide the movable coupling of the plurality of wall panels 15.

Figure 3:
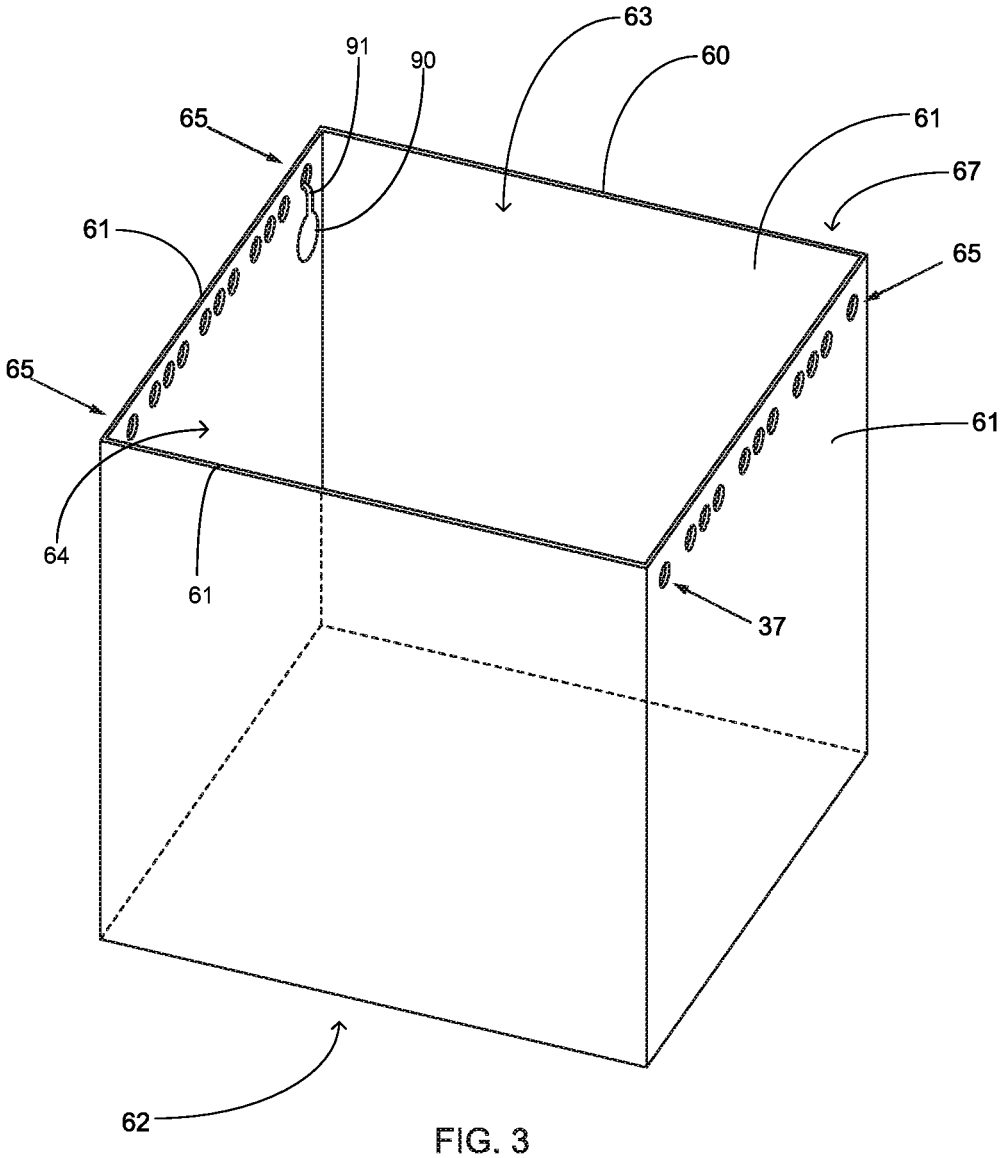
FIG. 3 is a perspective view of an embodiment of the liner of the present invention.

Illustrated herein in FIG. 3 is an embodiment of the liner 60 of the present invention. The liner 60 lines the modular receptacle so as to create a reservoir configured to receive and retain a liquid such as but not limited to water. The liner 60 is manufactured from a durable material such as but not limited to plastic. In a preferred embodiment the liner 60 is manufactured from a thermal plastic with a full panama weave reinforced polyester. As the liner will have a significant volume of water disposed therein, the aforementioned material for the liner 60 is preferred. The liner 60 includes a plurality of walls 61 and a bottom 62 integrally formed to create an interior volume 63. The liner 60 is manufactured of a size and shape so as to be mateably inserted into the interior volume 20 of the modular receptacle 10. The liner 60 includes opening 64 providing access to the interior volume 63. While not particularly illustrated herein, it is contemplated within the scope of the present invention that the liner 60 could be formed so as to be completely closed wherein a valve or similar element could be employed to control the filling and release of water from the liner 60.

Subsequent being disposed within the interior volume 20 of the modular receptacle 10 the liner 60 is secured in position utilizing grommets 65 wherein the grommets 65 are engage with silicone ties so as to secure the upper edge 67 of the liner 60 proximate the upper end 30 of the modular receptacle 10. While silicone ties are utilized in a preferred embodiment, it is contemplated within the scope of the present invention that alternate techniques and/or materials could be utilized to secure the liner 60. Furthermore, it should be understood within the scope of the present invention that metal reinforced silicone ties are preferred due to volume/weight of the water that is disposed within the liner 60. While the spacing and quantity for the grommets 65 illustrated herein shows a specific quantity and spacing for the location of the grommets 65 in the liner 60, it is contemplated within the scope of the present invention that the liner 60 could have alternate quantities and spacing's of the grommets 65. It is also contemplated within the scope of the present invention that the grommets 65 could be positioned in various places on the liner 60. Ensuing installation of the liner 60, the interior volume 63 thereof is filled with water wherein the water level is filled so as to be proximate the upper edge 67 of the liner 60. The weight of the water causes the walls 61 of the liner 60 to slightly propagate through apertures 40 as previously mentioned herein. As illustrated herein in FIG. 5, the flood control system 100 is designed to have a plurality of modular receptacles 10 installed adjacent to each other wherein an installation could be hundreds of meters long or longer so as to prevent floodwaters from entering a region. As the modular receptacles 10 are placed adjacent each other and the liners 60 filled with water, the slight propagation of the liner wall 61 through the aperture 40 creates a desirable sealing effect against the adjacent modular receptacle 10 so as to substantially inhibit the floodwaters from egressing therethrough.

The liner 60 includes a drain weight 90 operably secured to one of the grommets 65, preferably a grommet 65 located in the corner of the modular receptacle. The drain weight 90 is secured to the grommet 65 utilizing tie member 91. The tie member 91 is secured to the drain weight 90 and is journaled through the grommet 65 and secured to the sidewall 15 ensuing installation of the liner 60. The drain weight 90 is positioned within the interior volume 63 of the liner 60 so as to inhibit engagement with the sidewall 15. The drain weight 90 is operable to lower the upper edge 67 of the liner 60 ensuing release of the tie member 91. Subsequent release of the tie member 91, the drain weight 90 will fall towards the bottom 62 and as such the water disposed within the interior volume 63 will egress from the liner 60. Utilizing the drain weight 90, provides an efficient technique of draining the interior volume 63 of the liner 60 as opposed to alternate techniques such as but not limited to hose transfer. It is contemplated within the scope of the present invention that the drain weight 90 could be formed in alternate sizes and shapes and achieve the desired objective as described herein.

Figure 5:
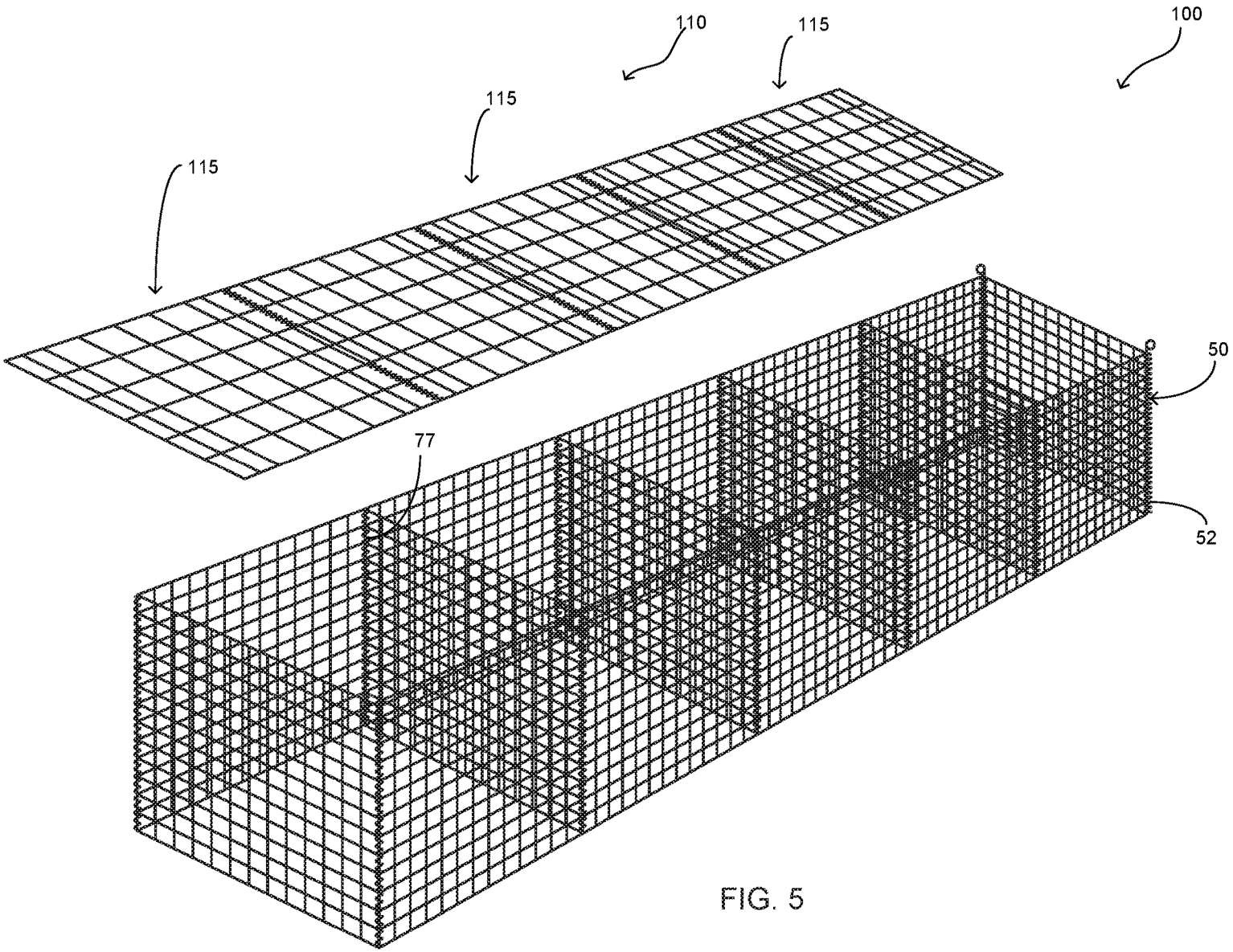
FIG. 5 is a perspective view of the present invention with the lid removed.

As shown herein in a preferred embodiment of the flood control system 100 a configuration of multiple integrated modular receptacles 10 is desirable. While no particular quantity is required, in the preferred embodiment of the present invention a configuration of a two-cell or a five-cell system is desirable. As is illustrated in FIG. 5, the flood control system includes a dividing wall 77 for the multi-cell configurations. The dividing wall 77 is constructed identically as the walls 15 described herein. While a two-cell or five-cell system is desirable, it is within the scope of the present invention that a single modular receptacle 10 could be deployed. As previously discussed herein, the corners 50 are helical coil structures 52. During installation of adjacent multi-receptacle configurations, locking pins 90 are utilized to operably couple adjacent modular receptacles 10. The locking pin 90 includes elongated member 91 that is of sufficient length so as to extend the length of wall panels 15 and penetrate the ground. A second portion 92 is contiguously formed with the first portion 91 so as to form a void 93 therebetween. The second portion 92 is configured to overlap the coupled helical coil structures 52 so as to provide a secure coupling thereof. It is contemplated within the scope of the present invention that the flood control system 100 could utilize alternate structures in order to couple adjacent multi-receptacle configurations of the flood control system 100. It is contemplated within the scope of the present invention that the locking pin 90 be utilized only for the securing of adjacent modular receptacles 10 and not provide securing thereof to the ground. It is further contemplated within the scope of the present invention that the modular receptacles 10 could be secured to the ground utilizing various fasteners and/or techniques that may or may not incorporate the locking pins 90.

Figure 4:
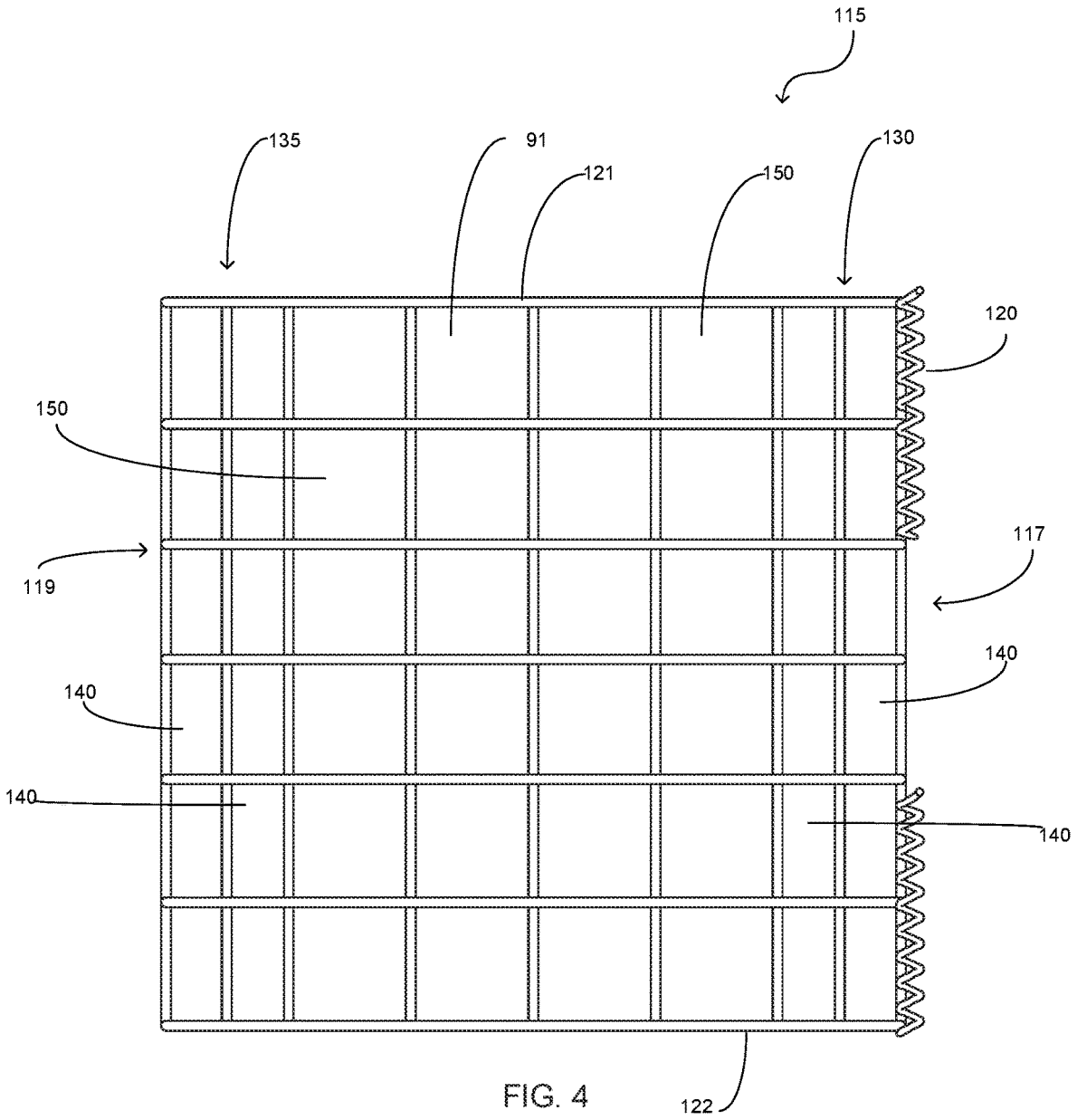
FIG. 4 is a top view of one section of the lid member of the present invention.

The flood control system 100 incorporates a first style and a second style of lid member 110 that is configured to superpose the top of the flood control system 100. Illustrated herein in FIGS. 4 and 5 is a preferred metal lid member 110 of the flood control system 100. The lid member 110 includes a plurality of sections 115 that are operably coupled utilizing a helical coil 120 on one edge 117 thereof. The helical coil 120 facilitates the foldable connection of sections 115. Each section 115 of the lid member 110 is manufactured from material such as but not limited to galfan metal mesh and is formed of a suitable size to cover the first opening 36 of the modular receptacles 10. Each section 115 includes opposing edges 117,119 and a top edge 121 and bottom edge 122 defining the square shape of the section 115. Formed proximate each opposing edge 117,119 are locking aperture rows 130,135. The locking aperture rows 130,135 are formed of apertures 140 that are more narrow in width compared to lid apertures 150. The reduced width of the apertures 140 and the formation of two rows thereof, provide a suitable interface so that adjacent sections 115 can be secured together and to the modular receptacles 10 utilizing a padlock or similar device with a limited shank reach. The locking aperture rows 130,135 are designed with more narrow apertures 140 as most conventional padlocks only have shanks that are a couple of inches in length. In order to secure the first opening 36 and inhibit access thereto ensuing the liner 60 being filled with water, the lid member 110 and the sections 115 thereof are padlocked to the modular receptacles 10. While no particular width of the apertures 140 is required good results have been achieved utilizing apertures 140 that are no wider than two and a half inches wherein the lid apertures 150 are approximately six inches in width. While the locking row apertures 130,135 are illustrated herein as having two adjacent rows of apertures 140, it is contemplated within the scope of the present invention that the locking row apertures 130,135 could have more or less than two rows of apertures 140.

While not particularly illustrated herein, the flood control system 100 incorporates a second style of lid member. The second style of lid member is a plastic membrane formed of a suitable size so as to cover the first opening 36 and partially extend downwards along the sidewalls 15. The second style of lid member is provided so as to offer a lid style that will reduce the amount of water evaporation from the liner 60 ensuing being filled with water. A second style lid member manufactured from a plastic membrane could be secured to the sidewalls 15 with conventional fasteners such as but not limited to clips. The second style lid member provides an alternative when the flood control system 100 is deployed in an area where securing the first opening 36 is not as critical for safety but more desirable for inhibiting water loss through evaporation.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A flood control system that that is configured to be superposed a ground area for control of flood waters wherein the flood control system comprises:

a plurality of modular receptacles, said plurality of modular receptacles configured to be operably coupled, said plurality of modular receptacles having a plurality of walls, said plurality of walls configured to define an interior volume, said plurality of walls having an interior surface and an exterior surface, said plurality of walls having a plurality of apertures formed thereacross, wherein each of said plurality of walls includes corner structures, said corner structures movably coupling each of said plurality of walls so as to facilitate the transition intermediate the folded position and the deployed position, said corner structures being helical coil in form, said plurality of modular receptacles having an upper end and a lower end, said plurality of modular receptacle having a first opening proximate said upper end, said plurality of modular receptacles having a second opening, said second opening being proximate said bottom end;

at least one locking member, said at least one locking member configured to secure adjacent modular receptacles, said at least one locking member being elongated in manner and having a portion extending along one of said plurality of walls, said at least one locking member having a second portion configured to penetrate the ground area on which the plurality of modular receptacles are superposed;

a liner, said liner being non-permeable, said liner having a plurality of walls and a bottom integrally formed to create an interior volume, said liner having an upper edge and a lower edge, said liner having a plurality of grommets formed therein proximate said upper edge, said liner having an opening proximate said upper edge providing access to said interior volume of said liner, said liner configured to be disposed within said interior volume of each of said plurality of modular receptacles, said opening of said liner being proximate the upper end of said plurality of modular receptacles subsequent said liner being disposed within said interior volume of said plurality of modular receptacles, said liner having a fluid disposed in said interior volume thereof, said liner having a plurality of portions propagating through said plurality of apertures, said liner further having secured thereto a drain weight, said drain weight being secured to one of said plurality of grommets proximate said upper edge of said liner;

a lid member, said lid member configured to be superposed said first opening of said plurality of modular receptacles, said lid member consisting of a plurality of sections, each of said plurality of section being manufactured from a mesh panel consisting of square body apertures, wherein each of said plurality of sections include opposing lateral edges, a top edge and a lower edge, said lid member configured to be foldable such that each of said plurality of sections are superposed each other, wherein each of said plurality of sections of said lid member include locking aperture rows, said locking aperture rows being adjacent said opposing lateral edges; and wherein said plurality of modular receptacles are movable intermediate a folded position and a deployed position wherein in the folded position said plurality of walls are adjacent each other.

2. The flood control system as recited in claim 1, wherein said drain weight has a first position and a second position, in said first position said drain weight is secured proximate said upper end of said plurality of modular receptacles with a tie member, wherein said tie member is secured to said drain weight journaled through one of said plurality of grommets and secured to the upper end of the plurality of modular receptacles.

3. The flood control system as recited in claim 2, wherein the flood control system is provided having modular receptacles selected from a group consisting of at least one of the following configurations: a two-cell configuration or a five-cell configuration.

4. The flood control system as recited in claim 3, wherein each of said plurality of sections of said lid member includes a first locking aperture row and a second locking aperture row, said first locking aperture row and said second locking aperture row being proximate said opposing lateral edges.

5. The flood control system as recited in claim 4, wherein said locking aperture rows comprise two rows of apertures wherein the two rows of apertures are comprised of apertures having a width that is less than a width of the square body apertures of the plurality of sections.

6. The flood control system as recited in claim 5, wherein said locking aperture rows comprise two rows of apertures wherein the two rows of apertures are comprised of apertures having a width that is less than a width of the square body apertures of the plurality of sections.

7. A flood control system that that is configured to receive and store a fluid therein that is operable to be deployed for control of floodwaters comprising:

a plurality of modular receptacles, said plurality of modular receptacles being superposed a ground surface, said plurality of modular receptacles configured to be operably coupled, said plurality of modular receptacles having a plurality of walls, said plurality of walls having an interior surface and an exterior surface, said plurality of walls configured to define an interior volume, said plurality of walls further including a plurality of apertures, said plurality of apertures being substantially across said plurality of walls, said plurality of walls including a corner structure, said plurality of modular receptacles having an upper end and a lower end, said plurality of modular receptacles having a first opening proximate said upper end, said plurality of modular receptacles having a second opening, said second opening being proximate said bottom end;

a plurality of locking members, said plurality of locking members configured to secure adjacent modular receptacles, said plurality of locking members being elongated in manner and having a portion extending through said corner structure, said plurality of locking members having a second portion configured to penetrate the ground surface on which the plurality of modular receptacles are superposed;

a liner, said liner being non-permeable, said liner having a plurality of walls and a bottom integrally formed to create an interior volume, said liner having an upper edge and a lower edge, said liner having a plurality of grommets proximate said upper edge, said liner configured to have a fluid disposed therein, said liner configured to be disposed within said interior volume of each of said plurality of modular receptacles, said liner having a plurality of portions propagating through said plurality of apertures, said plurality of portions of said liner propagating through said plurality of apertures such that said plurality of portions extend beyond said exterior surface of said plurality of walls;

a lid member, said lid member configured to be superposed said first opening of said plurality of modular receptacles, said lid member consisting of a plurality of sections, each of said plurality of section being manufactured from a mesh panel consisting of square apertures, wherein each of said plurality of sections include opposing lateral edges, a top edge and a lower edge, said lid member configured to be foldable such that each of said plurality of sections are superposed each other, wherein each of said plurality of sections of said lid member include locking aperture rows, said locking aperture rows being adjacent said opposing lateral edges;

a drain weight, said drain weight being secured to one of said plurality of grommets proximate said upper edge of said liner and a portion of said wall of said plurality of modular receptacles adjacent thereto, said drain weight operable to lower said upper edge and empty the fluid from said liner ensuing being released from said wall of said plurality of modular receptacles; and wherein the corner structures of said plurality of walls of said plurality of modular receptacles facilitate movement intermediate a folded position and a deployed position wherein in the folded position said plurality of walls are adjacent each other.

8. The flood control system as recited in claim 7, and further including a tie member, said tie member being operably coupled to said drain weight and one of said plurality of grommets of said liner, said tie member operable to retain said drain weight proximate said upper end of said plurality of modular receptacles.

9. The flood control system as recited in claim 7, wherein one of said opposing lateral edges of the plurality of section of the lid member further includes a helical coil formed as a part thereof.

10. The flood control system as recited in claim 9, wherein the flood control system further includes a second lid member, said second lid member being a flexible membrane, said second lid member configured to be superposed said first opening of said plurality of modular receptacles.

* * * * *